US006922130B2

(12) United States Patent
Okamoto

(10) Patent No.: US 6,922,130 B2
(45) Date of Patent: Jul. 26, 2005

(54) SURFACE MOUNT COIL WITH EDGEWISE WINDING

(75) Inventor: Toshinori Okamoto, Iwata-gun (JP)

(73) Assignee: Minebea Co., Ltd., Kitasaku-gun (JP)

( * ) Notice: Subject to any disclaimer, the term of this patent is extended or adjusted under 35 U.S.C. 154(b) by 27 days.

(21) Appl. No.: 10/413,553

(22) Filed: Apr. 15, 2003

(65) Prior Publication Data

US 2003/0218527 A1 Nov. 27, 2003

(30) Foreign Application Priority Data

May 24, 2002 (JP) ..... 2002-150831

(51) Int. Cl.[7] ..... H01F 27/30
(52) U.S. Cl. ..... 336/208; 336/192; 336/198
(58) Field of Search ..... 336/83, 90, 192, 336/198, 208

(56) References Cited

U.S. PATENT DOCUMENTS 4,656,450 A * 4/1987 Jarosz et al. ..... 336/83
5,805,431 A * 9/1998 Joshi et al. ..... 361/836
5,912,609 A * 6/1999 Usui et al. ..... 336/83
6,114,932 A * 9/2000 Wester et al. ..... 336/65
6,504,463 B1 * 1/2003 Kato et al. ..... 336/83
6,617,948 B2 * 9/2003 Kuroshima et al. ..... 336/83
2003/0052767 A1 * 3/2003 Yamanobe et al. ..... 336/232

* cited by examiner

*Primary Examiner*—Anh Mai
(74) *Attorney, Agent, or Firm*—Oliff & Berridge, PLC

(57) ABSTRACT

A surface mount coil comprises: a flanged spool, which includes a spool section and a flange section integrally connected with one end of the spool section; a base flange, which is shaped substantially rectangular and fixedly connected to the other end of the spool section; and an edgewise wound coil, which is made of a rectangular insulated wire, and which is structured such that starting and finishing ends of the rectangular insulated wire lead out in parallel with each other around the base flange in such a manner as to extend along and on one side surface, a bottom surface, and another side surface opposite to the one side surface, and are fixed at an edge of a top surface of the base flange.

17 Claims, 7 Drawing Sheets

SURFACE MOUNT COIL WITH EDGEWISE WINDING

BACKGROUND OF THE INVENTION

1. Field of the Invention

The present invention relates to a surface mount coil using a drum core.

2. Description of the Related Art

A conventional surface mount coil using a drum core has been extensively used and is constructed such that, as shown in FIG. 1, a round insulated wire is wound around a spool portion 53 of a drum core 50 which is integrated with a top flange 51 and a base flange 52 so as to constitute a drum core 50 and both ends of the round insulated wire is connected to respective connecting terminals of plate-like metallic lead frames 55 and 55. The plate-like metallic lead frames 55 and 55 are adhesively fixed to the drum core thereby constituting a pair of terminal electrodes of the coil. The electrodes have been conventionally called "lead frame type electrodes". In addition, although not shown, there are other types structured such that lead terminals are provided on an insulating board made of resin and adapted for receiving a coil and winding ends are connected to the lead terminals, thereby constituting electrodes, such that electrode materials are coated at a portion on a drum core and baked and winding ends are connected to the coated portion thereby constituting electrodes, or such that winding ends are bound around and soldered to a flange of a drum core thereby constituting electrodes.

Furthermore, there is another type surface mount coil using a drum core, which is structured such that a rectangular insulated wire is wound edgewise. Since this type of coil is superior to the type using the round insulated wire in winding efficiency ratio of wire space to winding space, it is advantageous in reduction in size and profile and also in that the wire is flat and can be used as plate-like metallic electrodes.

The above mentioned types of surface mount coils with round insulated wires wound therearound have had the following defects.

In the type where the both ends of the round insulated wire are bound around and connected to the connecting terminals of the plate-like metallic lead frames, its production cost is increased because the lead frames (the electrodes) have to be discretely provided, and an additional operation process is required for fitting the lead frames thus involving a cost increase.

In the type where the lead terminals are provided on the insulating board made of resin, and winding ends are connected to the coated portion thereby constituting electrodes, a cost increase is involved due to additional materials, specifically the electrode materials, and also due to an additional operation process for coating and baking the electrode materials.

The type, where winding ends are bound around and soldered to the flange of the drum core thereby constituting electrodes, has a limited allowable value of current and therefore cannot be used in a heavy-current circuit, and also often incurs shakiness when mounted on a printed circuit board.

Furthermore, although another type coil, where the rectangular insulated wire is wound edgewise, is superior to the coil using the round insulated wire in reduction in profile, number of parts, manufacturing operation, and allowable value of current, it has the following reliability problems. Specifically, this type coil suffers a decreased soldered area of the winding ends constituting electrodes due to the soldered portion peeling off from the core or plastic board and flatness shakes and is lifted off when mounted on a printed circuit board.

SUMMARY OF THE INVENTION

The present invention has been made in light of the above, and its object is to provide a surface mount coil which achieves miniaturization, reduction in profile, and an increased allowable value of current, and which has a high reliability when mounted on a printed circuit board.

In order to achieve the above described object, according to a first aspect of the present invention, a surface mount coil comprises: a flanged spool comprising a spool section and a flange section integrally connected with one end of the spool section; a base flange shaped substantially rectangular and fixedly connected to the other end of the spool section; and an edgewise wound coil made of a rectangular insulated wire, and structured such that starting and finishing ends of the rectangular insulated wire lead out in parallel with each other around the base flange in such a manner as to extend along and on one side surface, a bottom surface, and another side surface opposite to the one side surface, and are fixed at an edge of a top surface of the base flange.

According to a second aspect of the present invention, in the surface mount coil of the first aspect, the starting and finishing ends of the edgewise wound coil are fixed tightly on at least one notch formed on the another side surface opposite to the one side surface of the base flange.

According to a third aspect of the present invention, in the surface mount coil of the first or second aspect, the starting and finishing ends of the edgewise wound coil are provided with solder thereby constituting electrodes.

According to a fourth aspect of the present invention, in the surface mount coil of the third aspect, a bridge is provided between the electrodes on the bottom surface of the base flange.

According to a fifth aspect of the present invention, in the surface mount coil of the third or fourth aspect, the electrodes are fixed to the bottom surface of the base flange by means of adhesive.

According to a sixth aspect of the present invention, in the surface mount coil of the fifth aspect, the bottom surface of the base flange is provided with at least one adhesive pit and a plurality of adhesive guiding grooves for filling and guiding adhesive.

According to a seventh aspect of the present invention, in the surface mount coil of the sixth aspect, edges of the base flange are chamfered.

According to an eighth aspect of the present invention, in the surface mount coil of any one of the first to seventh aspects, a plastic covering case is provided, which covers the edgewise wound coil and the flanged spool, and which is fixedly attached to the base flange.

According to a ninth aspect of the present invention, in the surface mount coil of the eighth aspect, the plastic covering case is fixed to the base flange such that hooks provided on the plastic covering case are engaged with grooves provided on the base flange, and an inner surface of a top of said plastic covering case presses against the flange section of the flanged spool.

In this configuration, since the rectangular insulated wire as the electrodes is tightly fixed on at least one notch formed on the base flange, the edgewise wound coil can be securely fixed to the base flange. Also, since the starting and finishing ends of the edgewise wound coil are provided with solder and the electrodes each having a large area for soldering are fixed with adhesive, defects such as shakiness, liftoff, connection failure, and wire breakage can be cut down as well as miniaturization, low-profile, and a high reliability for supplying a large current can be achieved. Further, since the plastic covering case is securely engaged with the base flange by means of the hooks, and since the plastic covering case presses elastically against the flanged spool, the coil can be fixed easily and securely to the base flange during manufacture of the coil, thereby improving its reliability.

BRIEF DESCRIPTION OF THE DRAWINGS

FIGS. 7A and 7B are views of an embodiment of a method for applying adhesive between a base flange and an electrode, wherein FIG. 7A shows a state before adhesive is applied, and FIG. 7B shows a state after adhesive is applied;

DETAILED DESCRIPTION OF THE PREFERRED EMBODIMENTS

Preferred embodiments of the present invention will be described hereinafter with reference to the accompanying drawings.

Figure 1:
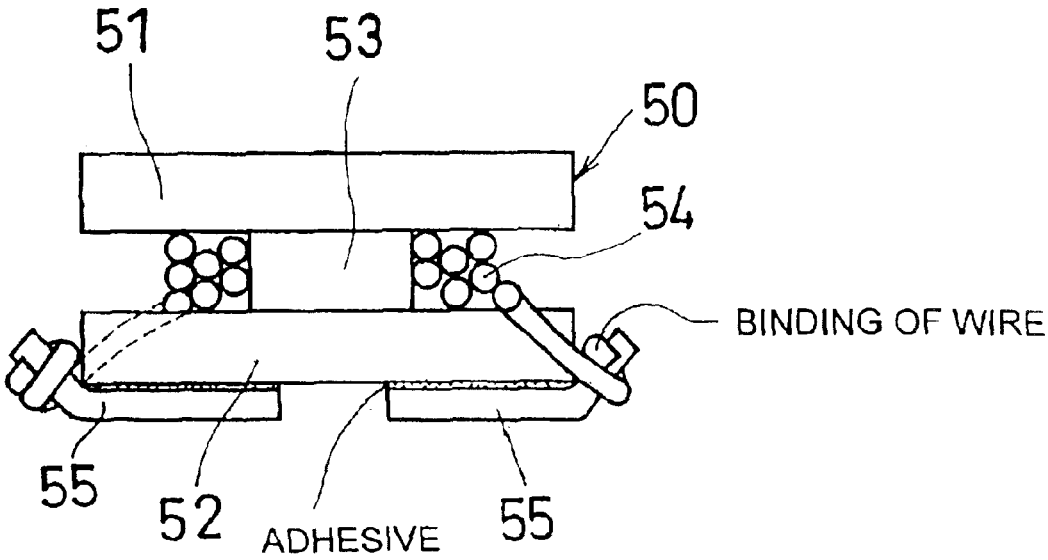
FIG. 1 PRIOR ART
FIG. 1 is a side view of a conventional surface mount coil.
Figure 2:
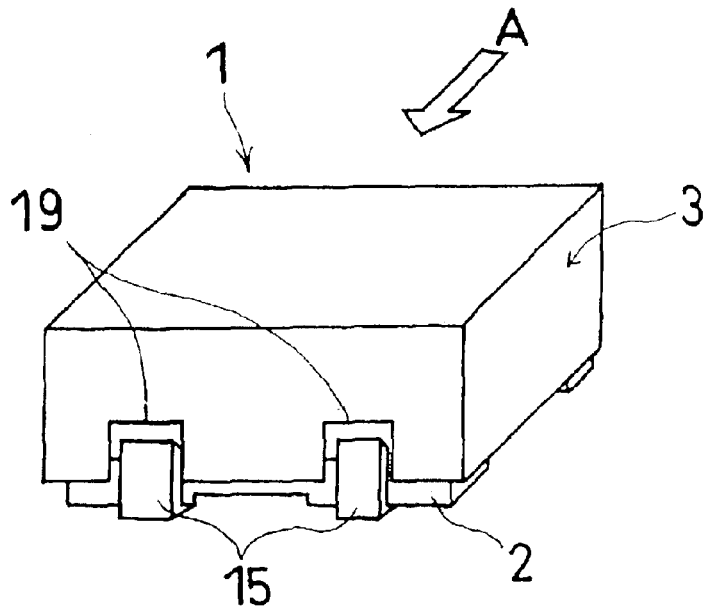
FIG. 2 is a perspective view of a surface mount coil according to an embodiment of the present invention.

Referring to FIG. 2, a surface mount coil 1 is substantially a rectangular parallelepiped and is structured such that a substantially rectangular base flange 2 is covered with a plastic covering case 3 placed therein. As will hereinafter be detailed, electrodes have electrode fixation portions 15 which have their distal ends hooked to be fixedly attached to the base flange 2.

Figure 3:
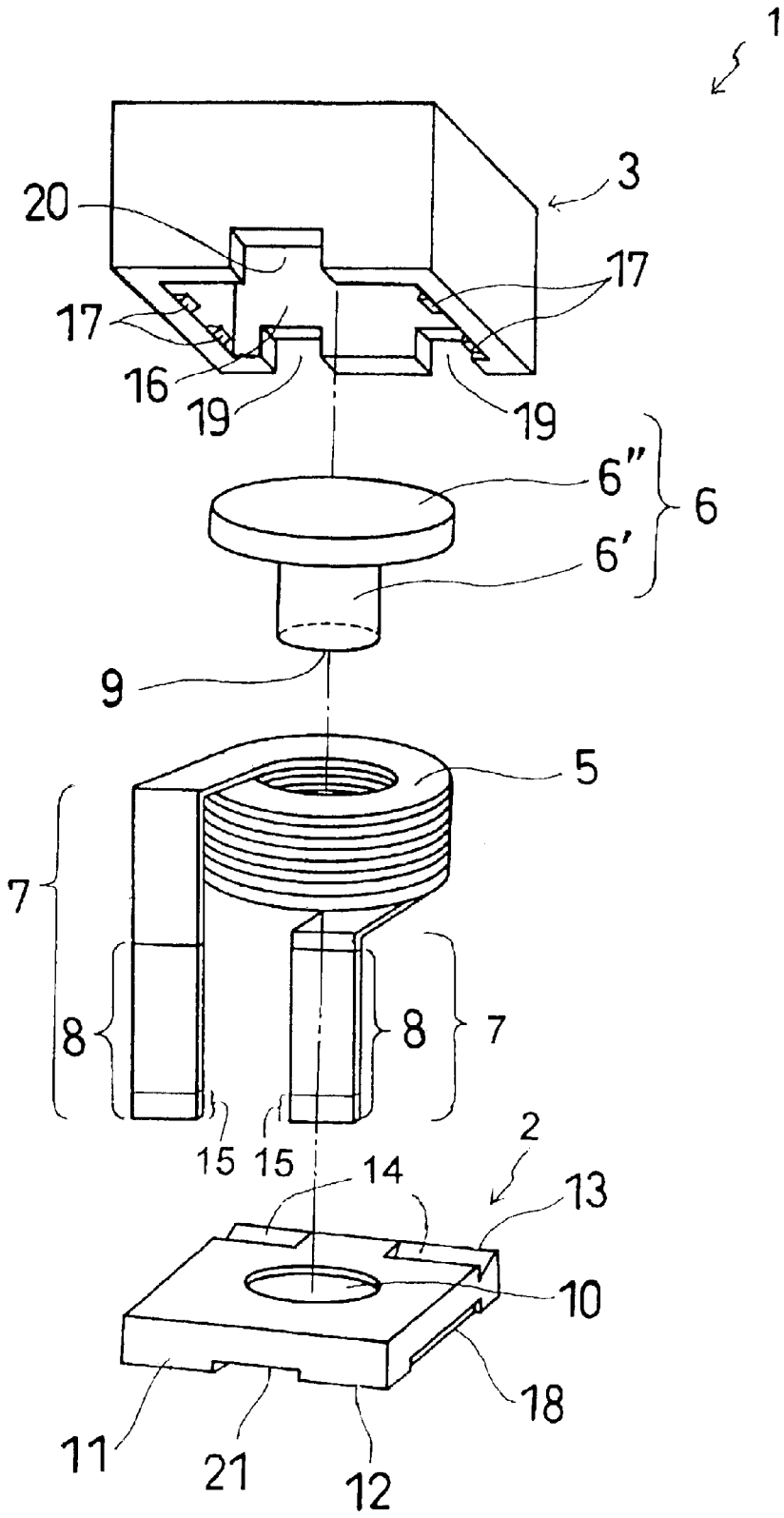
FIG. 3 is an exploded perspective view of the surface mount coil shown in FIG. 2.

Referring to FIG. 3, the surface mount coil 1 is viewed from a direction shown by an arrow A in FIG. 2. The surface mount coil 1 is generally composed of: an edgewise wound coil 5 made of a rectangular wire; a flanged spool 6 including a spool section 6' to be inserted in the edgewise wound coil 5 and a flange section 6" integrally connected to one end of the spool section 6"; the aforementioned base flange 2 which is substantially rectangular and to which the other end 9 of the spool section 6' is fixed (fitted into a cavity 10) adhesively; and the aforementioned plastic covering case 3 which is fixed to the base flange 2 and which covers the above components.

Lead wires 7 and 7 (a starting portion and a finishing portion) of the edgewise wound coil 5 made of a rectangular insulated wire lead out substantially in parallel with each other in the same direction, and respective end portions 8 and 8 of the lead wires 7 and 7 have their insulation resin peeled off and provided with solder. Thus, electrodes are formed by a rectangular insulated wire alone, which is a coil material. Since the rectangular insulated wire has a thickness of 0.05 to 0.1 mm, the surface mount coil can readily achieve a lower profile in its entirety, compared with a conventional coil, which uses a round insulated wire and lead frames as electrodes.

Since the edgewise wound coil 5 itself is formed into a bobbin shape, the surface mount coil 1 is separated into the base flange 2 and the flanged spool 6, and the spool section 6' of the flanged spool 6 goes through the edgewise wound coil 5, and has its end 9 adhesively fixed into the cavity 10 formed on the base flange 2. In this connection, the base flange 2 is made of Ni—Zn ferrite or Mg—Zn ferrite, both of which are high-resistance ferrite materials, for adhesively fixing the electrodes, but the flanged spool 6 does not necessarily have to be made of a high-resistance ferrite material. When there are requirements for high-performance characteristics (high-inductance, high-bias characteristic, and large-current capacity), or for miniaturization, the requirements can be met by using Mn—Zn ferrite.

The lead wires 7 and 7 of the edgewise wound coil 5 using a rectangular insulated wire are bent after the end portion of the spool section 6' of the flanged spool 6 is fixed with adhesive to the base flange 2. More specifically, the lead wires 7 and 7 extend along and on one side surface 11 of the base flange 2, bend so as to extend along and on a bottom surface 12 of the base flange 2, bend again so as to extend along and on the other side surface 13 opposite to the one side surface 11, and have their ends hooked to be fixed into notches 14 formed in a top surface of the base flange 2, whereby end portions 8 and 8 with insulation resin peeled off and provided with solder thereon are disposed along and on the bottom surface 12 and the other side surface 13 to constitute electrodes of the surface mount coil 1.

Furthermore, a recess 21 (a bridge between the electrodes) is formed between the electrodes in such a manner as to cross the bottom surface 12 of the base flange 2. With this structure, the electrodes 12 can be brought into a secure contact with land portions of a printed circuit board when the surface mount coil 1 is mounted on the printed circuit board.

In this connection, the flange section 6" of the flanged spool 6 does not have to be shaped circular, but may alternatively be shaped, for example, rectangular. On the other hand, the base flange 2 is preferably shaped rectangular in order to secure a large area in the bottom surface 12 for the end portions of the lead wires 7 and 7, that is, the electrodes, whereby the surface mount coil 1 is provided with a large area for soldering and can be securely fixed onto the printed circuit board thereby improving reliability.

Figure 4:
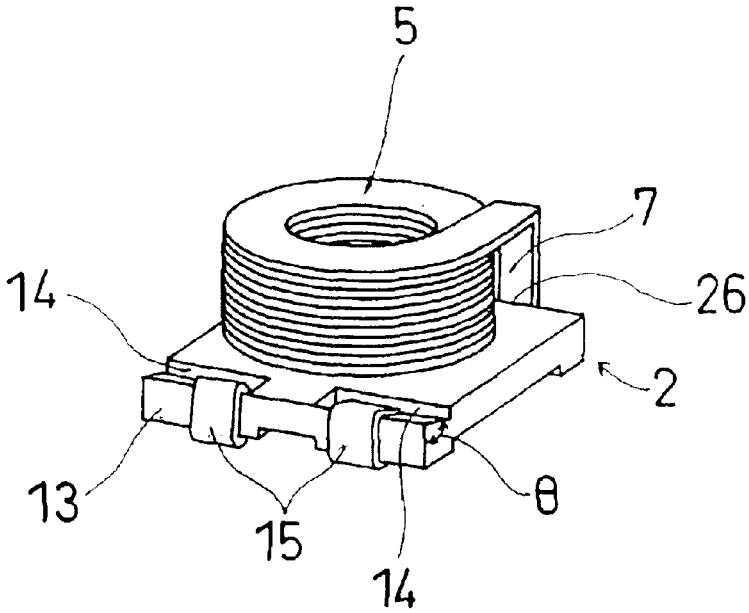
FIG. 4 is a perspective view of an edgewise wound coil fixed to a base flange.

Referring to FIG. 4, the lead wires 7 and 7 of the edgewise wound coil 5 are wired along and on the bottom surface 12 of the base flange 2 and further along and on the other side surface 13 and have their ends, that is, the distal ends of the electrode fixation portions 15 hooked to be fixed into respective notches 14 thereby constituting electrodes. FIG. 4 shows a view seen from a direction opposite to FIG. 3, removing the flanged spool 6.

Figure 5A:
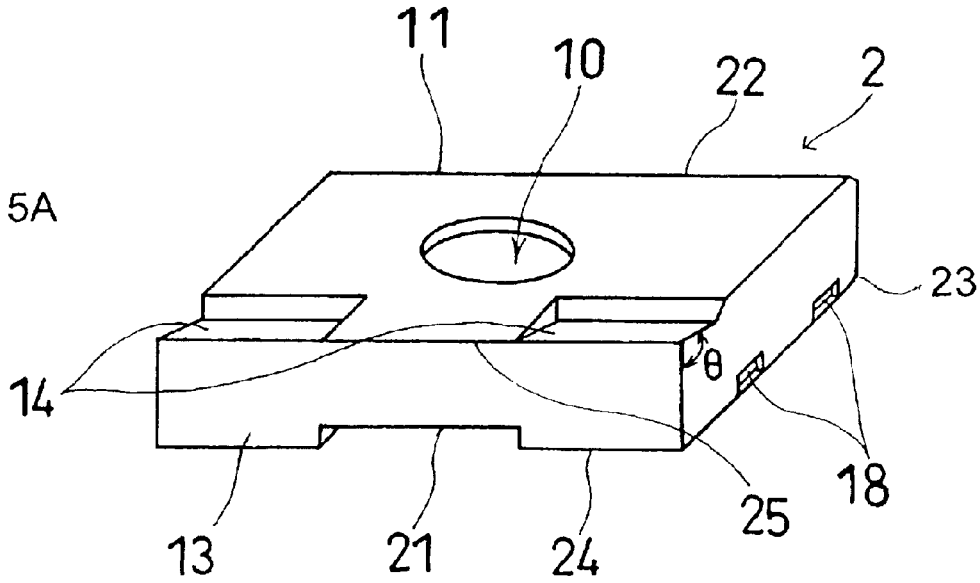
FIG. 5A is a perspective view of the base flange.
Figure 5B:
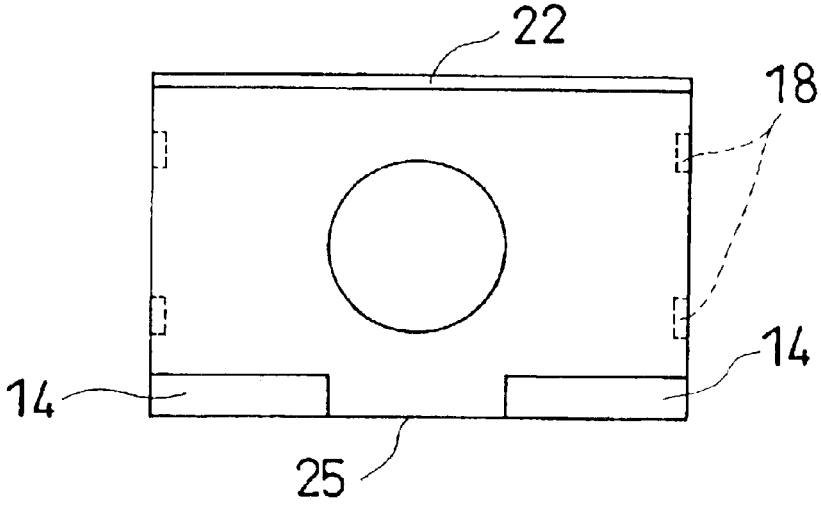
FIG. 5B is a top plan view of the base flange.
Figure 5C:
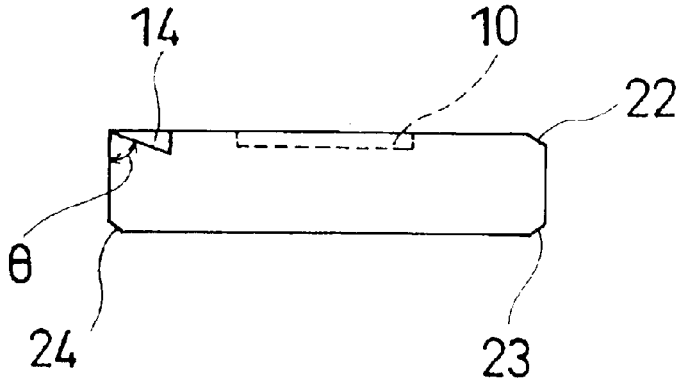
FIG. 5C is a side view of the base flange.

In order to securely fix the lead wires 7 and 7 (electrodes), the base flange 2 is structured as follows. Referring to FIGS. 5A to 5C, the base flange 2 has four edges (specifically, two edges 22 and 23 at the one side surface 11, and another two edges 24 and 25 at the other side surface 13) by which the lead wires 7 and 7 pass. While the edges 22, 23 and 24 are chamfered, the edge 25 which is continuous with the notches 14 and 14 for fixing the electrodes are not chamfered. With the chamfers, the lead wires 7 and 7 (electrodes) can be bent comfortably and are kept away from lifting off the surfaces of the base flange 2. Also, the chamfer formed at the edge 22 of the one side surface 11 serves as a reservoir for adhesive to fix the lead wires 7 and 7 to the one side surface 11 of the base flange 2 (see 26 in FIG. 4).

Furthermore, the edge 25 has an angle θ of less than 90 degrees at the notches 14 and 14 so that the hooked ends of the lead wires 7 and 7 can be securely caught. Two notches 14 and 14 are formed to correspond in number to the electrodes in this embodiment, but the number of the notches does not have to correspond to the number of the electrodes as long as the ends of the lead wires 7 and 7 can be securely caught for fixation. For example, only one notch for fixing the two electrodes may be formed, that extends all the way from one end to the other end of the edge 25, or that terminates toward the both ends of the edge 25.

Referring back to FIG. 2, the aforementioned plastic covering case 3 is configured like a box with an open bottom 16, is adapted to house the edgewise wound coil 5, and the flanged spool 6, and is attached onto the base flange 2 whereby the surface mount coil 1 can be protected against a shock suffered when mounted by an automatic inserting machine and also against a shock suffered at the time of handling, which prevents breakage of the magnetic core and assures its electric insulation. On each of inner side surfaces of the plastic covering case 3 at the open bottom 16 opposing each other, two hooks 17 are formed for catching the base flange 2, whereby the plastic covering 3 is fixed onto the base flange 2 such that the two hooks 17 and 17 engaged with two grooves 18 and 18 formed respectively at bottom edges of side surfaces of the base flange 2 opposing each other (the plastic covering case 3 will be further explained later). In this connection, the method for fixing the plastic covering case 3 on the base flange 2 is not limited to the above described method by means of the hooks, and may alternatively be, for example, by means of adhesive, without providing the hooks, such that the inner surfaces of the plastic covering case 3 are bonded to the side surfaces of the base flange 2.

Furthermore, three cutouts 19, 19 and 20 are formed on two other inner side surfaces than the two inner side surfaces, on each of which the two hooks 17 and 17 are formed. The cutouts 19 and 19 are formed in such a manner as to correspond respectively to the notches 14 and 14, and are adapted to accommodate the electrode fixation portions 15 and 15, respectively. The ends of the electrode fixation portions 15 and 15 are hooked using a fixing jig after the plastic covering case 3 is fixed onto the base flange 2. Therefore, the cutouts 19 and 19 are positioned and sized so as to get clear of the fixing jig. On the other hand, the cutout 20 has a width equivalent to a distance between respective inner sides of the lead wires 7 and 7 disposed at the one side surface 11 of the base flange 2. The cutout 20 allows adhesive to be easily filled into the chamfer formed at the edge 22 for securely fixing the lead wires 7 and 7 to the one side surface 11.

As described above, the end portion 9 of the spool section 6' of the flanged spool 6 inserted in the edgewise wound coil 5 is adhesively fixed to the cavity 10 formed on the base flange 2. When the lead wires 7 and 7 of the edgewise wound coil 5 are bent and hooked to be wired around the base flange 2, the base flange 2 and the edgewise wound coil 5 must be fixedly held to each other. Here, the plastic covering case 3 equipped with the hooks 17 and 17 functions as a means for fixing the edgewise wound coil 5 to the base flange 2.

Figure 6A:
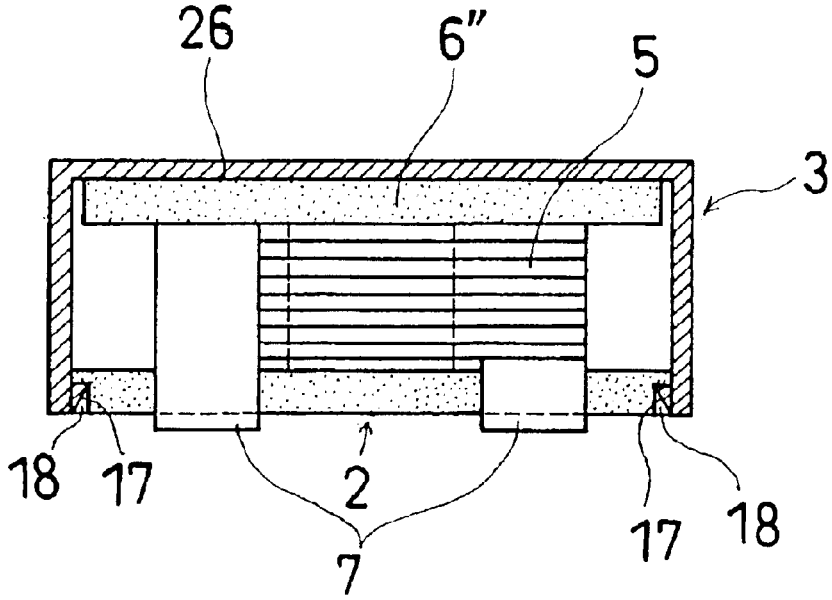
FIG. 6A is a sectional view of a surface mount coil, whose plastic covering case is fixed on the base flange.
Figure 6B:
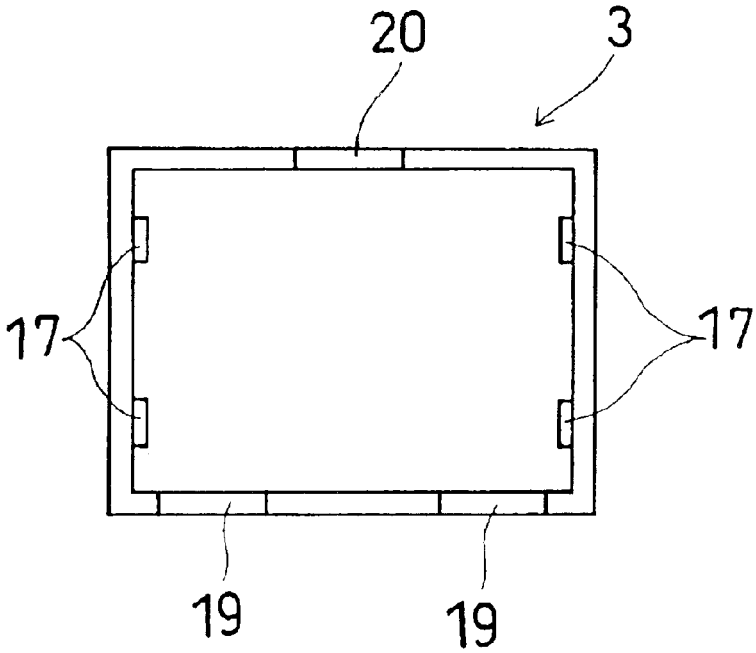
FIG. 6B is a bottom view of the plastic covering case.

Referring to FIGS. 6A and 6B, the two hooks 17 and 17 are formed on each of the inner surfaces of the base flange 2 opposing each other and not having the cutouts 19, 19 and 20, and are engaged respectively with the two hook grooves 18 and 18 formed on each of the side surfaces of the base flange 2. An inner surface 26 of a top of the plastic covering case 3 is in contact with the flange section 6" of the flanged spool 6 and presses against the flange section 6" by an elastic force of the plastic covering case 3. In short, the edgewise wound coil 5 is fixed to the base flange 2 by the elastic force which is generated at the plastic covering case 3 when the four hooks 17 are engaged with the four grooves 18.

As described above, the lead wires 7 and 7 of the edgewise wound coil 5 are fixedly hooked into the notches 14 and 14, serve as electrodes, and are bonded thereto in order to ensure a higher reliability.

In the case of a conventional surface mount coil using lead frame type electrodes, since the lead frame has a thickness of 0.1 to 0.2 mm, when adhesive is applied between the lead frame and the core in order to fix the lead frame to the core, there is less chance that the applied adhesive flows to reach a front side (electrode surface) of the lead frame due to surface tension. However, in the case of a surface mount coil using a rectangular insulated wire type electrodes, since the rectangular insulated wire has a thickness of 0.05 to 0.1 mm, when adhesive is applied between the base flange 2 and the electrodes formed of the rectangular wire in order to fix the lead wires 7 and 7 to the base flange 2, the applied adhesive flows, reaches a face side surface via the edge of the rectangular wire and stays thereon, thereby causing discontinuity.

Figure 7A:
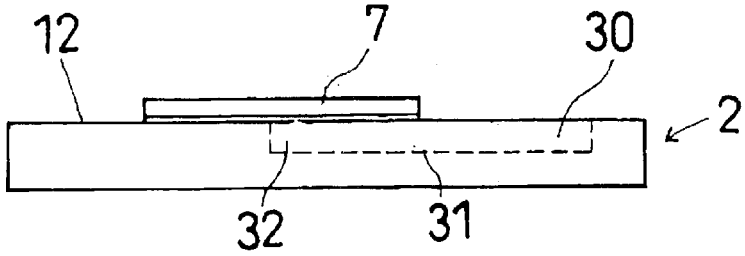
Figure 7B:
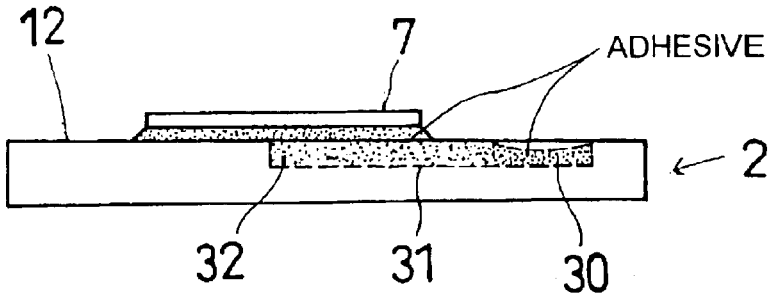

In this connection, a method of applying adhesive to solve the above described problem with the rectangular insulated wire type electrodes will be explained with reference to FIGS. 7A and 7B. An adhesive pit 30 for receiving adhesive applied is formed on the bottom surface 12 of the base flange 2 at an area where electrodes are not provided. The adhesive pit 30 also functions as a reservoir for the applied adhesive. An adhesive guiding groove 31 is formed which extends from the adhesive pit 30 (under the electrode in FIGS. 7A and 7B) up to the center of the electrode. And, another adhesive guiding groove 32 is formed which extends from the adhesive guiding bore 31 to the bottom surface 12 (upper side in the figures) where the electrode is provided.

In the above structure, adhesive is filled into the adhesive pit 30 and is reserved therein. The adhesive in the adhesive pit 30 does not flow into the adhesive guiding bore 31 due to its viscosity. Referring to FIG. 7B, when the adhesive is subjected to heat during a curing process, the adhesive has its viscosity temporarily lowered, flows into the adhesive guiding groove 31, then the groove 32, and creeps in a minimum amount required into a gap between the base flange 2 and the electrode due to the surface tension (creep phenomenon). Thus, the adhesive can be cured in a well-balanced condition, and the electrodes of the rectangular wire can be securely fixed on the base flange 2 without the adhesive sticking on the face side surface (the electrode side surface) of the rectangular wire.

Figure 8A:
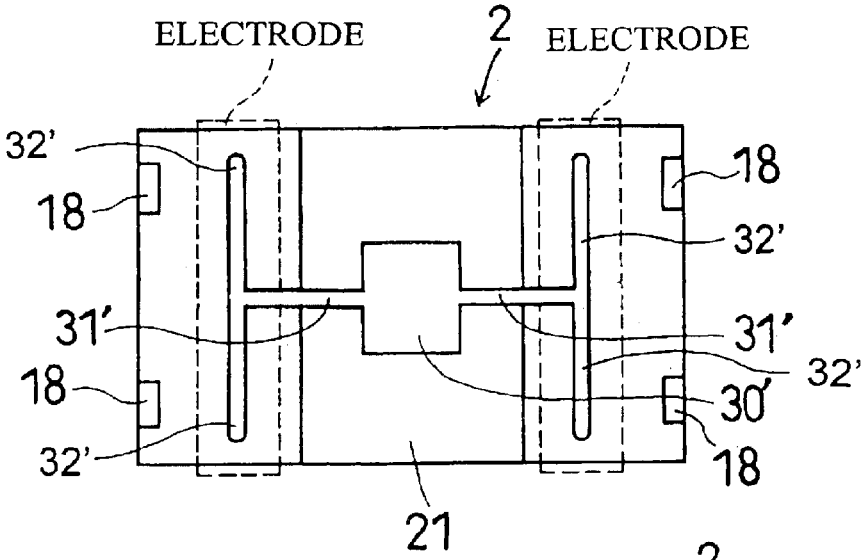
FIG. 8A is a bottom view of an embodiment of an adhesive pit and adhesive guiding grooves formed on the base flange.
Figure 8B:
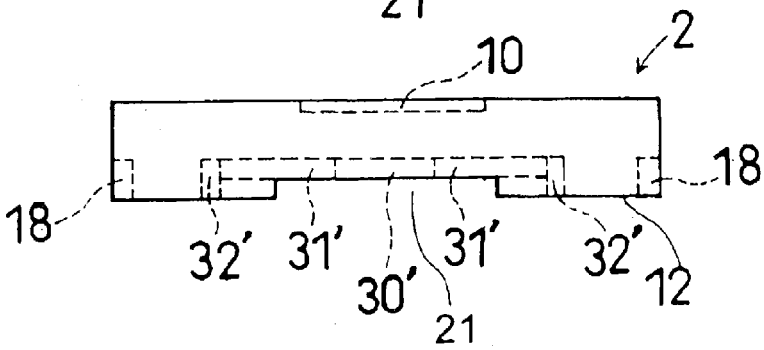
FIG. 8B is a side view of the embodiment shown in FIG. 8A.

An embodiment of an adhesive pit and adhesive guiding grooves will be described with reference to FIGS. 8A and 8B.

An adhesive pit 30' is formed between the two electrodes at the center of the bottom surface 12 of the base flange 2. Two first adhesive guiding grooves 31' and 31' are formed, which extend from the adhesive pit 30' toward respective electrodes (respectively toward the left and right in FIGS. 8A and 8B). Two second adhesive guiding grooves 32' and 32' are formed, each of which has its center portion connected with the outward end of each first adhesive guiding groove 31", and extends from the center portion in both directions (upward and downward in FIG. 8A) along the center of the width of each electrode.

With the grooves thus structured, adhesive filled in the adhesive pit 30' flows through the first adhesive guiding grooves 31' and 31' into the second guiding grooves 32' and 32', and the electrodes of the rectangular insulated wire can be adhesively fixed on the base flange 2 without the adhesive sticking on the face side surface (the electrode side surface) of the rectangular insulated wire in the same way as discussed with reference to FIGS. 7A and 7B.

Figure 9A:
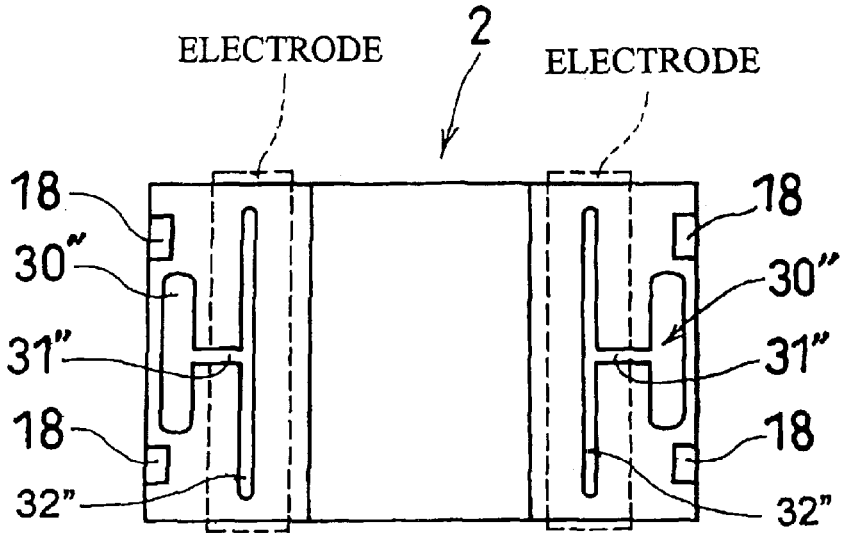
FIG. 9A is a bottom view of another embodiment of adhesive pits and adhesive guiding grooves formed on the base flange.
Figure 9B:
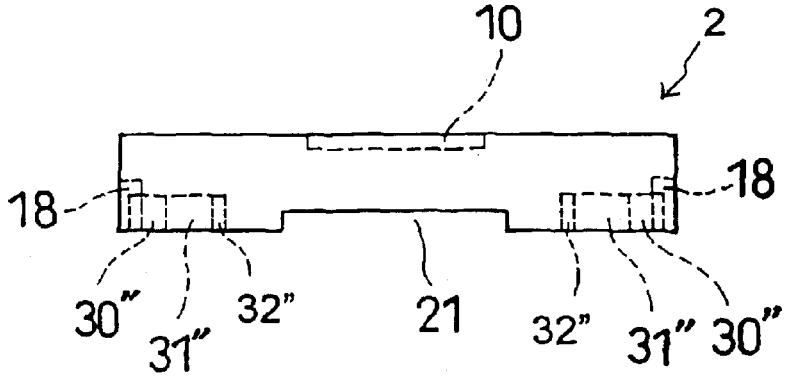
FIG. 9B is a side view of the embodiment shown in FIG. 9A.

Another embodiment of adhesive pits and adhesive guiding grooves is illustrated in FIGS. 9A and 9B. Two separate adhesive pits 30" and 30" are formed, which are each located outside of each of the electrodes toward the side provided with the grooves 18 and 18. Two first adhesive guiding grooves 31" and 31" are formed in such a manner as to extend from respective adhesive pits 30" and 30" toward respective electrodes. Two second adhesive guiding grooves 32" and 32" are formed, each of which has its center portion connected with the inward end of each guiding grove 31", and extends from the center portion in both directions (upward and downward in FIG. 9A) along the center of the width of each electrode.

With the structure above described, the adhesive filled in the adhesive pits 30'" and 30" can securely fix the electrodes of the rectangular insulated wire to the base flange 2.

What is claimed is:

1. A surface mount coil comprising:

a flanged spool comprising a spool section and a flange section integrally connected with one end of said spool section;

a base flange shaped substantially rectangular and fixedly connected to the other end of said spool section; and an edgewise wound coil made of a rectangular insulated wire, and structured such that starting and finishing ends of said rectangular insulated wire lead out in parallel with each other around said base flange in such a manner as to extend along and on one side surface, a bottom surface, and another side surface opposite to said one side surface, and are fixed at an edge of a top surface of said base flange.

2. A surface mount coil as claimed in claim 1, wherein a plastic covering case is provided, which covers said edgewise wound coil and said flanged spool, and which is fixedly attached to said base flange.

3. A surface mount coil as claimed in claim 2, wherein said plastic covering case is fixed to said base flange such that hooks provided integrally on said plastic covering case are engaged with grooves provided on said base flange, and wherein an inner surface of a top of said plastic covering case presses elastically against said flange section of said flanged spool.

4. A surface mount coil as claimed in claim 1, wherein said starting and finishing ends of said edgewise wound coil are fixed tightly on at least one notch formed on said another side surface opposite to said one side surface of said base flange.

5. A surface mount coil as claimed in claim 4, wherein said starting and finishing ends of said edgewise wound coil are provided with solder thereby constituting electrodes.

6. A surface mount coil as claimed in claim 4, wherein a plastic covering case is provided, which covers said edgewise wound coil and said flanged spool, and which is fixedly attached to said base flange.

7. A surface mount coil as claimed in claim 1, wherein said starting and finishing ends of said edgewise wound coil are provided with solder thereby constituting electrodes.

8. A surface mount coil as claimed in claim 7, wherein a plastic covering case is provided, which covers said edgewise wound coil and said flanged spool, and which is fixedly attached to said base flange.

9. A surface mount coil as claimed in claim 7, wherein a bridge is provided between said electrodes on said bottom surface of said base flange.

10. A surface mount coil as claimed in claim 9, wherein said electrodes are fixed to said bottom surface of said base flange by means of adhesive.

11. A surface mount coil as claimed in claim 9, wherein a plastic covering case is provided, which covers said edgewise wound coil and said flanged spool, and which is fixedly attached to said base flange.

12. A surface mount coil as claimed in claim 7, wherein said electrodes are fixed to said bottom surface of said base flange by means of adhesive.

13. A surface mount coil as claimed in claim 12, wherein a plastic covering case is provided, which covers said edgewise wound coil and said flanged spool, and which is fixedly attached to said base flange.

14. A surface mount coil as claimed in claim 12, wherein said bottom surface of said base flange is provided with at least one adhesive pit and a plurality of adhesive guiding grooves for filling and guiding adhesive.

15. A surface mount coil as claimed in claim 14, wherein a plastic covering case is provided, which covers said edgewise wound coil and said flanged spool, and which is fixedly attached to said base flange.

16. A surface mount coil as claimed in claim 14, wherein edges of said base flange are chamfered.

17. A surface mount coil as claimed in claim 16, wherein a plastic covering case is provided, which covers said edgewise wound coil and said flanged spool, and which is fixedly attached to said base flange.

* * * * *